US008578639B2

(12) United States Patent
Hurd

(10) Patent No.: US 8,578,639 B2
(45) Date of Patent: Nov. 12, 2013

(54) FABRIC PRESS

(76) Inventor: Andrew C. Hurd, Charlotte, NC (US)

( * ) Notice: Subject to any disclaimer, the term of this patent is extended or adjusted under 35 U.S.C. 154(b) by 189 days.

(21) Appl. No.: 13/169,700

(22) Filed: Jun. 27, 2011

(65) Prior Publication Data

US 2012/0324769 A1 Dec. 27, 2012

(51) Int. Cl.
*D06F 71/22* (2006.01)
*D06C 15/00* (2006.01)

(52) U.S. Cl.
USPC ..... 38/13; 223/52.1

(58) Field of Classification Search
USPC ..... 38/12, 13, 69; 223/52–71, 2
See application file for complete search history.

(56) References Cited

U.S. PATENT DOCUMENTS

| | | | | |
|---|---|---|---|---|
| 1,047,218 | A | | 12/1912 | Hatler |
| 1,350,583 | A | | 8/1920 | Willey |
| 1,667,286 | A | | 4/1928 | Clisson |
| 1,691,106 | A | | 11/1928 | Benjamin |
| 1,959,626 | A | | 5/1934 | Huebsch |
| 1,996,548 | A | | 4/1935 | McEwen |
| 2,051,854 | A | | 8/1936 | Holloway |
| 2,055,824 | A | | 9/1936 | Mall |
| 2,059,295 | A | | 11/1936 | Wilhelm |
| 2,147,597 | A | | 2/1939 | Long |
| 2,192,786 | A | | 3/1940 | Campbell |
| 2,196,810 | A | * | 4/1940 | Hoch ..... 38/141 |
| 2,254,653 | A | * | 9/1941 | Hoch ..... 38/13 |
| 2,469,226 | A | | 5/1949 | Forse |
| 2,470,516 | A | * | 5/1949 | Neckel ..... 38/13 |
| 2,483,812 | A | | 10/1949 | Davis et al. |
| 2,769,585 | A | | 11/1956 | Goldstein |
| 2,829,809 | A | | 4/1958 | Freeman |
| 2,886,221 | A | | 5/1959 | Todd |
| 3,586,219 | A | * | 6/1971 | Radford et al. ..... 223/57 |
| 3,901,420 | A | * | 8/1975 | Revuelta ..... 223/52.1 |
| 4,427,139 | A | | 1/1984 | Depriest |
| 4,890,401 | A | | 1/1990 | Weisfeld |
| 5,553,410 | A | | 9/1996 | Derby |
| 6,301,712 | B1 | | 10/2001 | Miyata |
| 6,324,776 | B1 | | 12/2001 | Miyata |
| 6,497,060 | B1 | | 12/2002 | Bolan, Jr. et al. |
| 7,000,340 | B1 | | 2/2006 | Uchikoshi |
| 7,838,798 | B2 | | 11/2010 | Uchikoshi |

* cited by examiner

*Primary Examiner* — Ismael Izaguirre
(74) *Attorney, Agent, or Firm* — Alston & Bird LLP

(57) ABSTRACT

An apparatus to press the collar of a shirt may include a base member with a first press surface, where the base is configured in the shape of a U and a lid member including a second press surface, where the lid member is configured generally in the shape of a U, where the lid member is hingedly attached to the base member, and wherein the second press surface is substantially complementary to the first press surface. In an open position, the first press surface is configured to receive a turndown style collar of shirt and in the closed position, the second press surface is configured to fit over and press the turndown style collar of the shirt.

22 Claims, 10 Drawing Sheets

FABRIC PRESS

TECHNOLOGICAL FIELD

Embodiments of the present invention relate to fabric presses configured to press fabrics and materials, and, more particularly, to a fabric press configured to press the collar of a shirt.

BACKGROUND

Fabrics and woven materials used for decorative purposes, such as when worn as clothing or used as drapery, may tend to wrinkle or retain creases through use. Further, when clothing is washed and dried in a conventional dryer or on a clothes line the clothing may take on additional wrinkles and creases from the washing and drying process. The ironing of fabrics is often used to remove such wrinkles and creases by applying heat, and sometimes moisture, to the fabric while pressing the fabric, between substantially flat surfaces. The heat serves to relax the fabric and the pressing between the flat surfaces flattens the fabric to remove the wrinkles and creases.

Ironing can be achieved through a conventional hand-held iron using a flat surface, such as an ironing board, on which the ironing is performed. The ironing may also be achieved by large presses, which are often found in commercial dry-cleaning and laundering establishments. Commercial presses are often very large pieces of machinery, which require large areas of floor space and use considerable energy. An advantage to the hand-held iron is the flexibility with which the operator can iron or press different portions of any particular garment or article being ironed. The relatively small size of the hand-held iron permits the operator to iron around obstacles such as buttons or seams; however, ironing a garment or other fabric item with a hand-held iron can be tedious and time consuming. Commercial presses, on the other hand, allow fast, high-volume pressing of fabrics despite being less discriminate with regard to contours, details, and obstacles of the fabrics being pressed. Some commercial presses are configured to press items of a particular shape, such as a shirt; however, these presses typically are oversized to accommodate the largest of shirts and may still not provide the finer detail ironing possible with hand-held irons.

It may be desirable to have a press that is small enough to be convenient for household use while offering the speed of a commercial press and allow for detail ironing usually achieved only with a hand-held iron.

BRIEF SUMMARY

Various embodiments of the present invention are directed to fabric presses to press the collar of a shirt. An example apparatus may include a base member with a first press surface, where the base is configured in the shape of a U, and a lid member including a second press surface, where the lid member is configured generally in the shape of a U. The lid member may be hingedly attached to the base member, and the second press surface may be substantially complementary to the first press surface. In an open position, the first press surface may be configured to receive a turnover style collar of shirt and in the closed position, the second press surface is configured to fit over and press the turnover style collar of the shirt. The first press surface may include a ridge extending along the length of the first press surface around the U shape and the first press surface may be configured to receive the fold of a turnover style collar of the shirt along the ridge of the first press surface.

The base member may include a reservoir for holding a liquid and the reservoir may include a heating element configured to heat the liquid. The first press surface may be substantially perforated, and in response to the liquid in the reservoir being heated, vapor may pass through the first press surface via the perforations. The lid member may be hingedly attached to the base portion proximate a curved portion of the U-shape. The base member may have a substantially triangular cross-section. The first press surface may be configured to receive a turnover style collar of a shirt, and a fold of the turndown style collar may be configured to be received along the ridge of the first press surface. The apparatus may also include a removable insert arranged on the first press surface configured to emboss a figure on the collar when the lid member is in the closed position. The apparatus may further include a hanger adapted to hang the apparatus on a door.

Another example embodiment of an apparatus for pressing the collar of a shirt may include a base member with a first press surface and where the base defines a cavity at least partially bounded by the first pressing surface. The apparatus may further include a lid member with a second press surface cooperative with the first press surface to press the collar of the shirt. The apparatus may also include a reservoir containing a fluid and a heating element disposed within the reservoir. The heating element may heat the fluid within the reservoir to generate steam and the steam generated from the fluid may heat the first pressing surface by passing through the cavity. The first pressing surface may include perforations and the steam may exit from the cavity through the perforations to facilitate the pressing of the collar of the shirt. The first press surface may include a removable insert, where the removable insert is configured to be replaced with an embossing insert. The base member may include at least one heat sink disposed within the cavity, the heat sink configured to conduct heat to the first press surface. The base member may be generally U-shaped and at least a portion of the base member may define a substantially triangular cross-section. The base member may include a ridge that extends around the U-shape, where the ridge may be configured to receive the fold of the collar of the shirt. The collar of the shirt may be a turnover collar and the apparatus may be configured to press the collar of the shirt while the turnover collar is folded.

Another example embodiment of the present invention may provide an apparatus for pressing the color of a shirt that includes a base member with a generally U-shaped length, where the base member includes a first press surface with a cross-section that is substantially V-shaped. The apparatus may also include a lid member with a generally U-shaped length, where the lid member includes a second press surface with a cross-section that is substantially V-shaped. The first press surface and the second press surface may be configured to cooperate to press a shirt collar therebetween. A ridge of the V-shaped first press surface may be configured to receive the fold of a turnover collar.

BRIEF DESCRIPTION OF SEVERAL VIEWS OF THE DRAWING(S)

Reference will now be made to the accompanying drawings, which are not necessarily drawn to scale, and wherein.

DETAILED DESCRIPTION

The present invention will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout. The terms top, bottom, side, up, down, upwards, downwards, vertical, horizontal, and the like as used below do not imply a required limitation in all embodiments of the present invention but rather are used herein to help describe relative direction or orientation in the example embodiments illustrated in the figures.

Various embodiments of the present invention provide a fabric press configured to remove wrinkles from a fabric or woven material when pressed and/or heated by the fabric press.

The pressing or ironing of fabrics, and in particular garments, such as shirts, is a time-consuming process that may be achieved through commercial laundry operations, which may launder and press a shirt, or through conventional household means, such as ironing on an ironing board. Having shirts pressed by a commercial laundry operation may cost a considerable amount of money over the useful life of a shirt and may inconvenience the owner of the shirt who would typically be required to drop-off and pick-up the shirts during the normal business hours of a cleaning business. Further, commercial laundry and pressing operations may use chemicals and temperatures which wear on the fabrics of shirts and may cause premature deterioration of the fabrics and seams of a shirt, thereby shortening its useful life. Notwithstanding, some shirts may not require washing and pressing after every use such that when a clean shirt is simply returned to a cleaner for the shirt to be pressed, the owner must pay for an unnecessary wash in addition to the pressing operation.

Laundering shirts at home or at a self-service laundry may require a shirt's owner to iron the shirt manually using a conventional hand-held iron. Ironing a shirt by hand is time consuming and often the results achieved are not ideal, particularly when ironing certain fabrics that tend to retain creases and wrinkles and when a person has difficulty ironing portions of the shirt that may have a contour (e.g., the cuffs or collar) on a substantially flat surface such as an ironing board.

Figure 1:
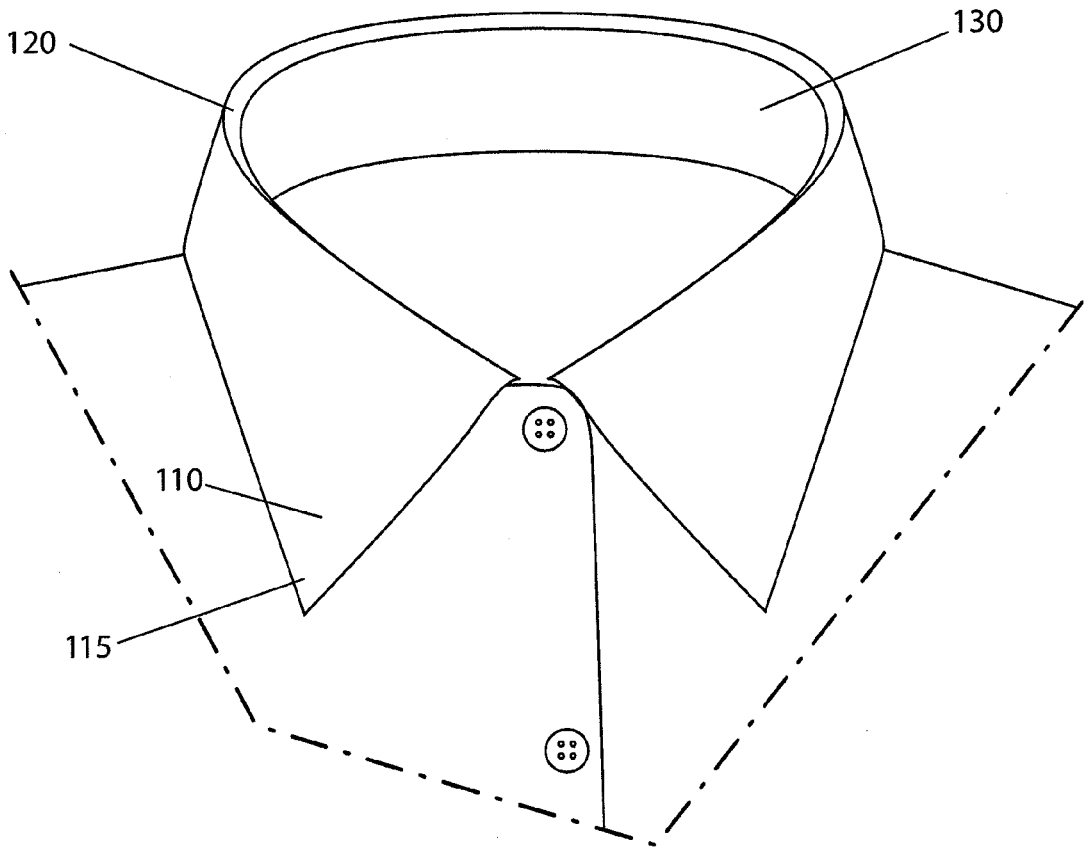
FIG. 1 illustrates an example of a turnover collar of a shirt.

There are many different collar designs and styles that have been used in clothing for many years; however, the turnover style collar, also known as a folded collar, is one of the most common collar style and is typically found on men's dress shirts, polo shirts, and women's blouses. The turnover style collar has a number of variations including the button-down, spread, straight, tab, and pinned varieties, among others; however, each has similarities which enable virtually any type of turnover style collar to benefit from embodiments of the present invention. An example of a turnover style collar is depicted in FIG. 1 illustrating the collar 110 including the points 115. The turnover collar also features a crease 120 at the fold between the collar 110 and the collar stand 130 or neckband. Typically, when a turnover collar is pressed in a commercial pressing operation, the collar is opened (i.e., the collar is unfolded at the crease 120) and the collar 110 is pressed flat with the collar stand 130. This pressing may introduce additional creases or wrinkles and may also cause a collar to not easily return to its folded position without the introduction of additional wrinkles or creases. Further, the crease 120 of the collar experiences additional, excess wear when alternately pressed flat and folded repeatedly over time.

Example embodiments of the present invention may provide a fabric press which enables a user to quickly and easily press the collar of a shirt in an easy, repeatable manner. In particular, embodiments of the present invention may allow a user to press the collar of a shirt in a relatively quick and repeatable manner to produce a properly pressed turnover collar.

Figure 2:
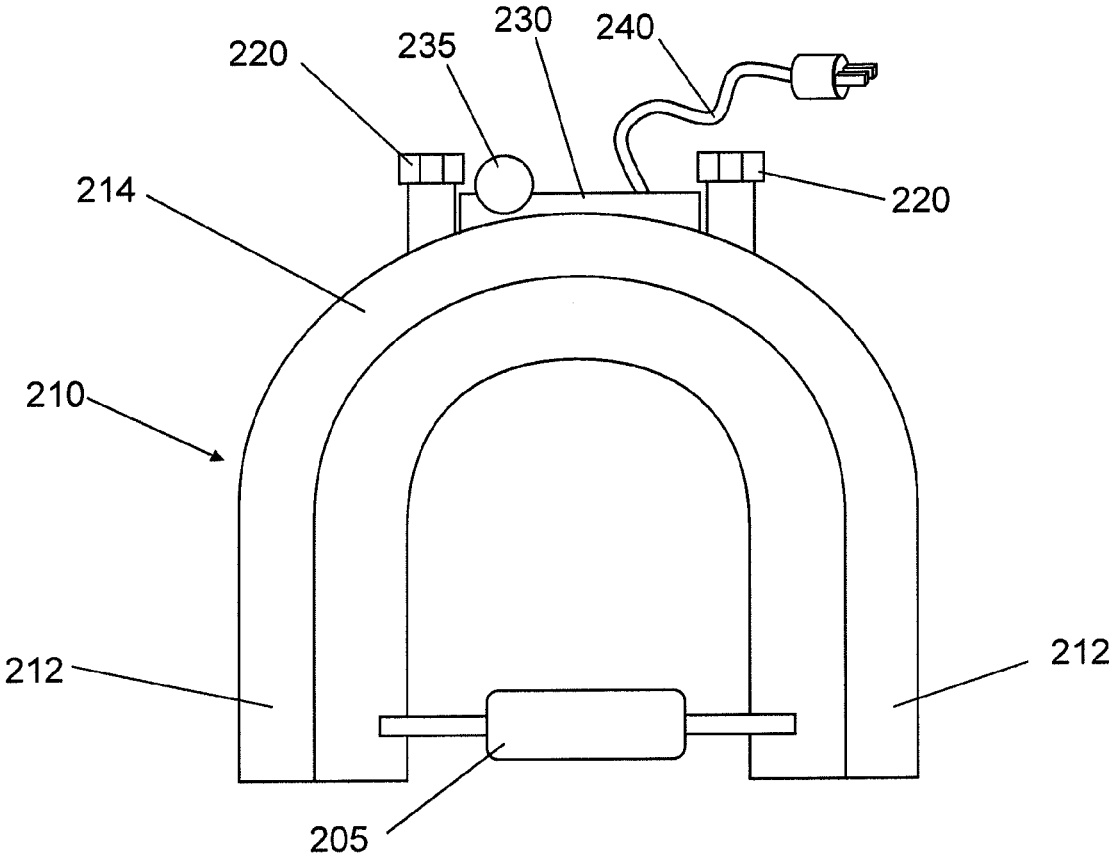
FIG. 2 depicts the top view of a fabric press according to an example embodiment of the present invention.
Figure 3:
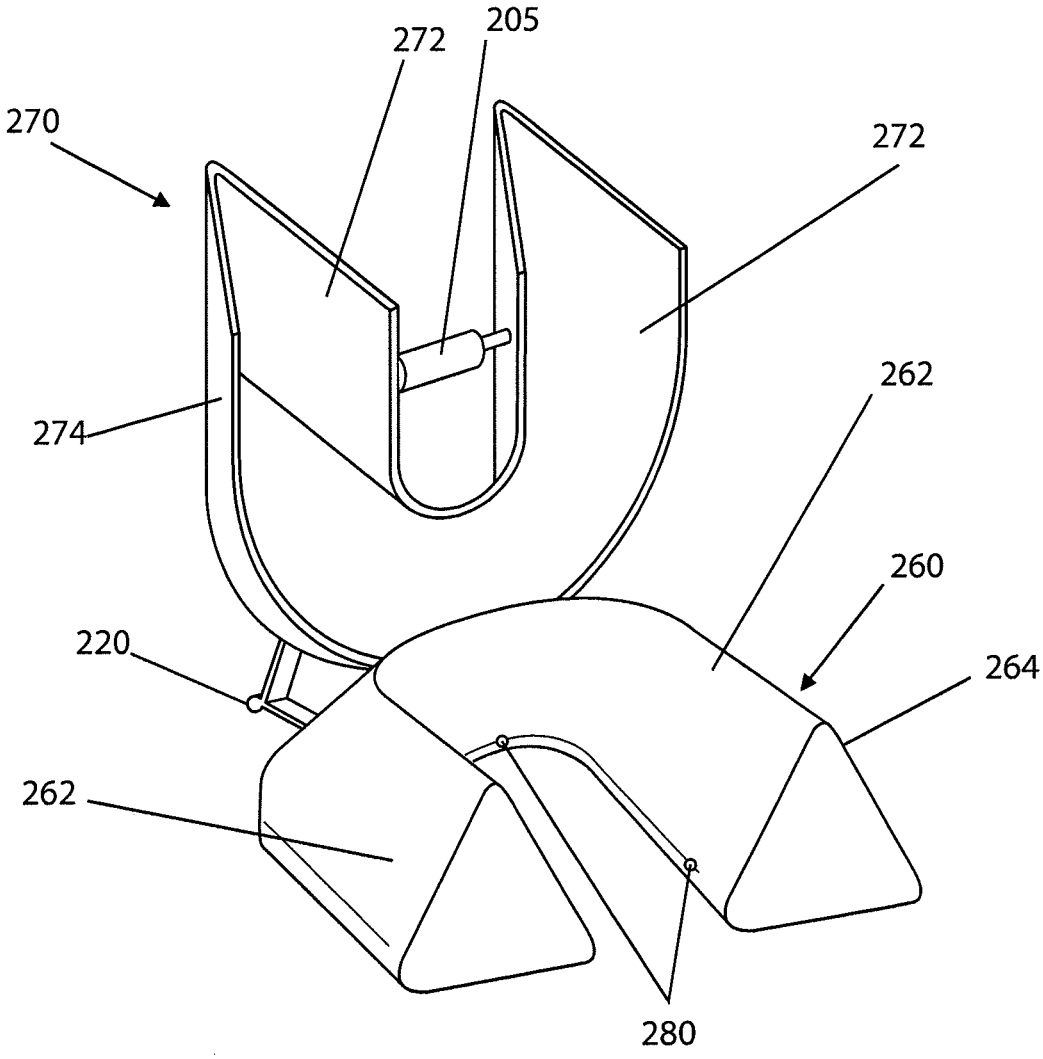
FIG. 3 illustrates a perspective view of a fabric press in an open position according to an example embodiment of the present invention.

FIGS. 2 and 3 illustrate a fabric press according to example embodiments of the present invention. FIG. 2 shows generally a top view of the press, while FIG. 3 depicts a perspective view, with the press in the open position. The press includes a press body 210 which is generally U-shaped and includes two substantially straight portions 212 joined by a curved portion 214. While the depicted embodiment illustrates a generally U-shaped press, it should be appreciated that a C-shaped press or a press that includes an arcuate portion between two ends may be equally effective. Thus, the term generally U-shaped may include any shape that involves an arcuate portion between two ends. The fabric press may include a reservoir 230 with a fill-port 235 and a power cord 240. A pair of hinges 220 may be disposed proximate the curved portion 214 for connecting a base member 260 of the press with the lid member 270 of the press. The base member 260 may include a substantially triangular cross-section while the lid member 270 may comprise a shape that is complementary to the triangular cross-section of the base member 260. The lid member 270 may further include a handle 205 that is of a material that is of a low thermal conductivity to preclude heat transfer to the handle 205 from the fabric press. The handle 205 may be arranged to provide additional rigidity to the lid portion 270 and the handle may provide leverage for a user that may apply additional pressing force to the pressing operation.

As shown in FIG. 3, the base member 260 may include a first press surface 262, where the first press surface includes two angled surfaces with a ridge 264 disposed therebetween. The lid member 270 may include a second press surface 272 which includes two angled surfaces and an apex 274 disposed therebetween such that the second press surface 272 is complementary to the first press surface 262. In the closed position, the first press surface 262 and the second press surface 272 are configured to be closely mated. The first press surface 262 may be made of a material, such as metal, which has a high thermal conductivity to transfer heat from the pressing surface to the fabric being pressed. The thickness of the material should be sufficient to maintain a rigid pressing surface under the forces exerted by a user or by the press when in operation. The second press surface may also be made of a material that has sufficient thickness to serve as a rigid pressing surface during operation of the press; however, the material may be one of a high thermal conductivity, or a very low thermal conductivity. A second press surface of a low thermal conductivity may insulate the first pressing surface when the press is closed between pressing operations, and a material of a low thermal conductivity may cause the heat transferred from the first press surface to be absorbed primarily by the fabric being pressed rather than the second pressing surface. Conversely, the second pressing surface may be made of a material with a high thermal conductivity such that it absorbs heat from the first pressing surface between pressing operations and thus a fabric that is pressed between the first press surface and the second press surface would receive heat from both the first press surface and the second press surface as the heat stored in the second press surface is transferred back to the fabric.

Figure 4:
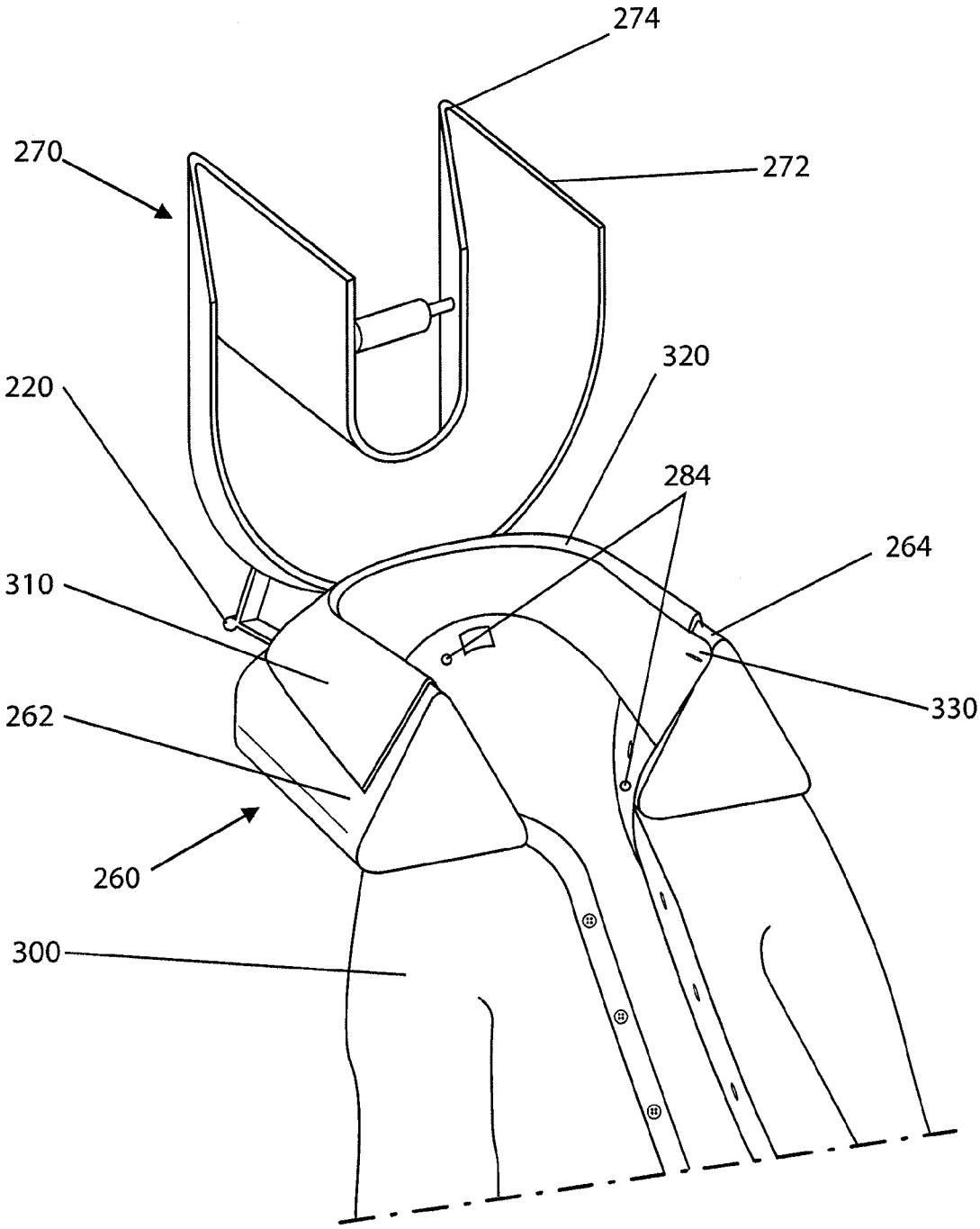
FIG. 4 illustrates a perspective view of a fabric press in an open position with a shirt collar disposed thereon according to an example embodiment of the present invention.

The first press surface 262 may be sized and shaped to receive the turnover collar 310 of a shirt 300 as illustrated in FIG. 4. The first press surface may have a substantially V-shaped cross section with the peak configured to receive the fold of the turnover collar. The fold 320 of the turnover collar 310 of the shirt 300 may be arranged along the ridge 264 of the first press surface 262. The collar stand 330 of the shirt 300 may be arranged on the first press surface 262 along the inner surface of the U-shape. The V-shaped cross-section of the first press surface 262 may constitute two sides of the substantially triangular cross-section of the base member 260. When the lid portion 270 is closed onto the base member 260, the second press surface 272 engages the collar with the fold 320 of the collar 310 received along the apex 274. The collar 310 is then pressed to the shape of the first press surface 262. The ridge 264 of the first press surface may include a relatively sharp point or a rounded edge with a radius of between about $1/16^{th}$ of an inch to about a half of an inch. The radius of the ridge may be determined by the type of collar that is intended to be pressed by the press surface 262.

A user may apply pressure to the lid member 270 to effect the pressing of the collar 310. In some cases, however, the lid member 270 may include enough weight to apply sufficient pressing force without additional, manually applied pressure. Further, the hinges 220 may include a spring-assist which aids in applying pressure between the lid member 270 and the base member 260. Such a spring-assist may include a cam mechanism to hold the lid member 270 in the open position when the lid member 270 opens beyond a predetermined angle, and the spring-assist may only exert additional closing pressure when the lid member 270 is closed to within a certain degree of the base member 260. Thus, the lid member 270 may be biased in the open position when opened, and biased in the closed position when closed. The lid member 270 or the base member 260 may include a clamping feature (not shown) that secures the lid member 270 to the base member 260 and may also be configured to apply a pressing force in the clamped position. The clamping feature may be configured to apply additional force as the clamp is secured. Such clamps may include a draw-bolt closure (such as may be used on tool boxes), twist latches (such as may be found on utility boxes, cabinets, or cases), or a cam-lock or latch that increases the closure force as the cam is rotated.

Example embodiments of the present invention may further include a mechanism by which the shirt collar may be held in position on the base member 260 without requiring an operator to manually hold the shirt in place. FIG. 3 depicts magnets 280 disposed below the press surface 262 of the base member 260. The magnets may be located at distinct locations in the base member, or generally surrounding the location where the shirt/collar interface will be disposed when a shirt is positioned within the press. FIG. 4 illustrates magnets 284 which have been placed over the magnets 280 of the base member 260, sandwiching the shirt 300 therebetween. The position of the magnets 280, 284 is such that the magnets are clear of lid member 270 and, thus, do not interfere with the engagement of the lid member 270 with the base member 260 during pressing. While the depicted embodiment shows magnets 280 on the base member 260 and magnets 284 attached thereto, the base member 260 may be formed, or partially formed of a magnetically attractive material such that the magnets 284 may be able to attach the shirt 300 directly to the base member 260.

Figure 5:
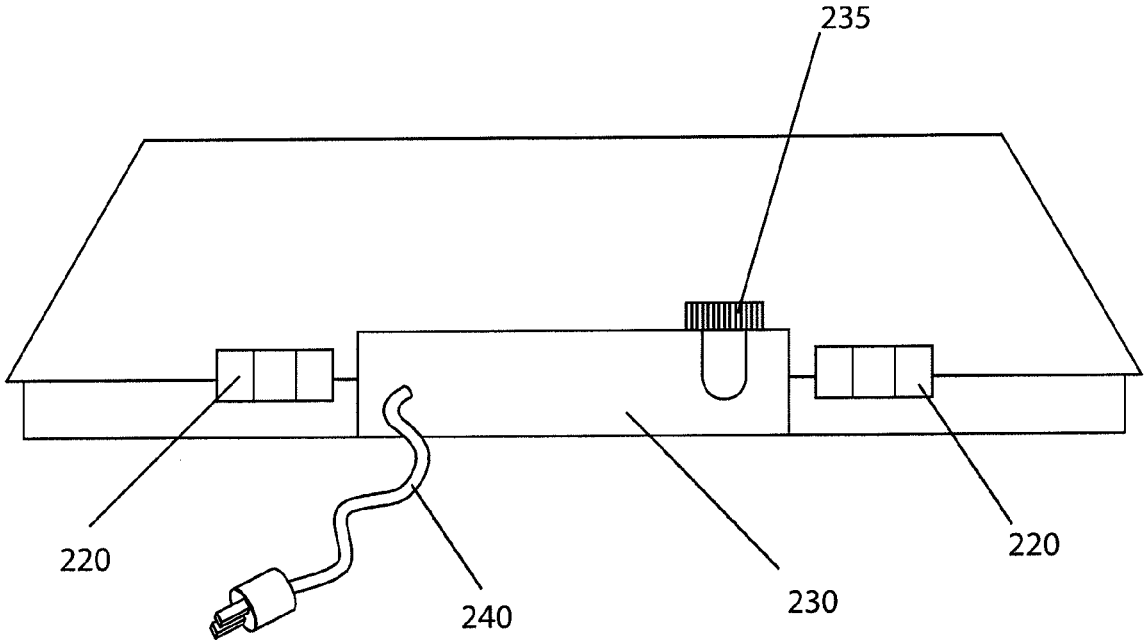
FIG. 5 illustrates a back view of a fabric press in a closed position according to an example embodiment of the present invention.

While the pressure between the lid member 270 and the base member 260 alone may provide a pressing and smoothing effect on the fabric of a collar, heat and/or steam may further aid in the pressing of the shirt collar. FIG. 5 illustrates a rear-view of an example embodiment of the fabric press in the closed position. As shown, the press includes reservoir 230 with fill port 235. The reservoir 230 may be configured to receive a fluid, such as distilled water. Disposed within the reservoir may be a heating element (not shown), such as an electrical resistance heating element. The power cord 240 may conduct power to the heating element within the reservoir to heat the fluid disposed therein. The reservoir and heating element may be sized according to the intended use of the press. For example, a press intended for personal household use by an individual or family may include a smaller reservoir, for example eight fluid ounces, and may have a heater operable on 110-volt household current. A press intended for extended use at a retail clothing establishment or other commercial establishment may include a larger reservoir and may have a higher power heater to efficiently heat the larger volume of fluid held in the reservoir.

Figure 6:
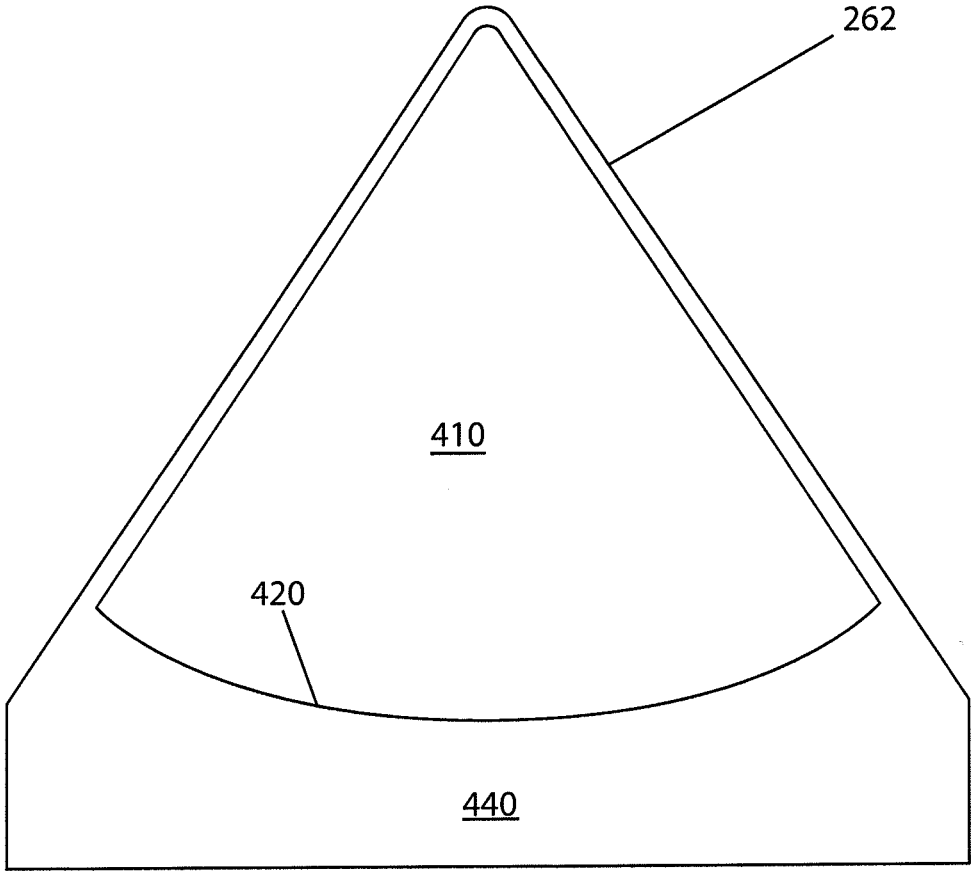
FIG. 6 depicts a cross-sectional view of a base member of a fabric press according to an example embodiment of the present invention.
Figure 7:
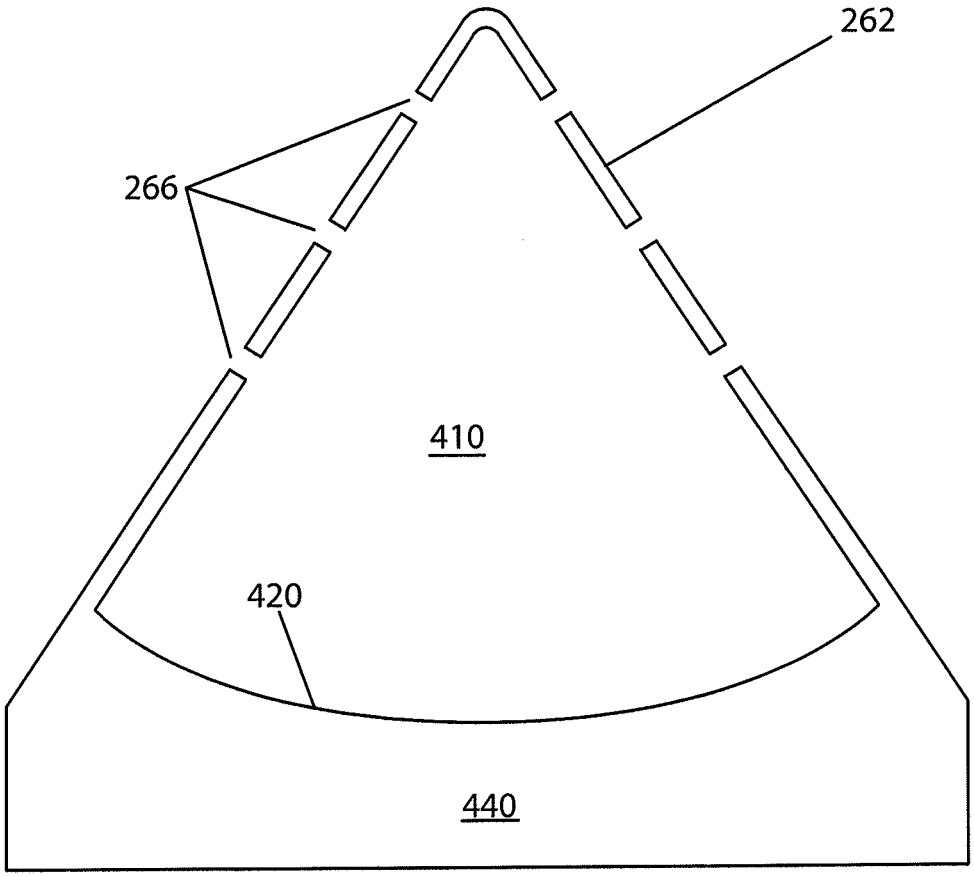
FIG. 7 depicts another cross-sectional view of a base member of a fabric press according to an example embodiment of the present invention.

The fluid held in the reservoir may be heated by the heating element to generate steam. Once converted to steam, the steam may flow throughout the base member 260 of the press to conduct heat to the first press surface 262. FIG. 6 illustrates a cross section of an example embodiment of a fabric press according to the present invention. The depicted cross-section includes the pressing surface 262 and a cavity 410 bounded by the pressing surface 262 on at least two sides. Steam may flow from the reservoir (not shown) through the cavity 410 that extends around the U-shape of the base member 260 of the press. Steam that condenses within the cavity on the under-side of the pressing surface 262, for example, may drip back into a channel or drain 420, which may then direct the liquid fluid back to the reservoir for re-heating. Optionally, the pressing surface 262 may include perforations 266 as illustrated in FIG. 7 such that steam passing through the cavity 410 may escape through the pressing surface 262 and facilitate the pressing of a collar. The number and size of the perforations 266 may be selected to be sufficient to allow the passage of steam therethrough, but not so large or prolific as to disrupt the pressing function of the first pressing surface 262. The perforations may also vary in size and shape depending upon the distance from the steam source so as to provide equal steam escape from the pressing surface 262 along the length of the pressing surface. Optionally, the perforations may be connected via capillaries to the source of the steam to further promote even steam distribution.

Example embodiments of a fabric press according to the present invention may further include an adjustable temperature setting to control the temperature of the press surface(s).

The adjustable temperature setting may be configured with temperature settings pre-determined to be appropriate for common fabrics or types of shirts that would be commonly used in a fabric press. Settings may include material types such as "cottons", "polyester", "blends", etc. and other settings may include fabric types such as "broadcloth", "oxford", or other fabric types. Settings may also simply include "high", "medium", and "low" for example.

An insulation material 440 may be provided within the press base member, below the cavity 410 to promote heat conductivity through the pressing surface 262 and to insulate the bottom of the base member 260, allowing the base to be safely placed on any surface.

Figure 8:
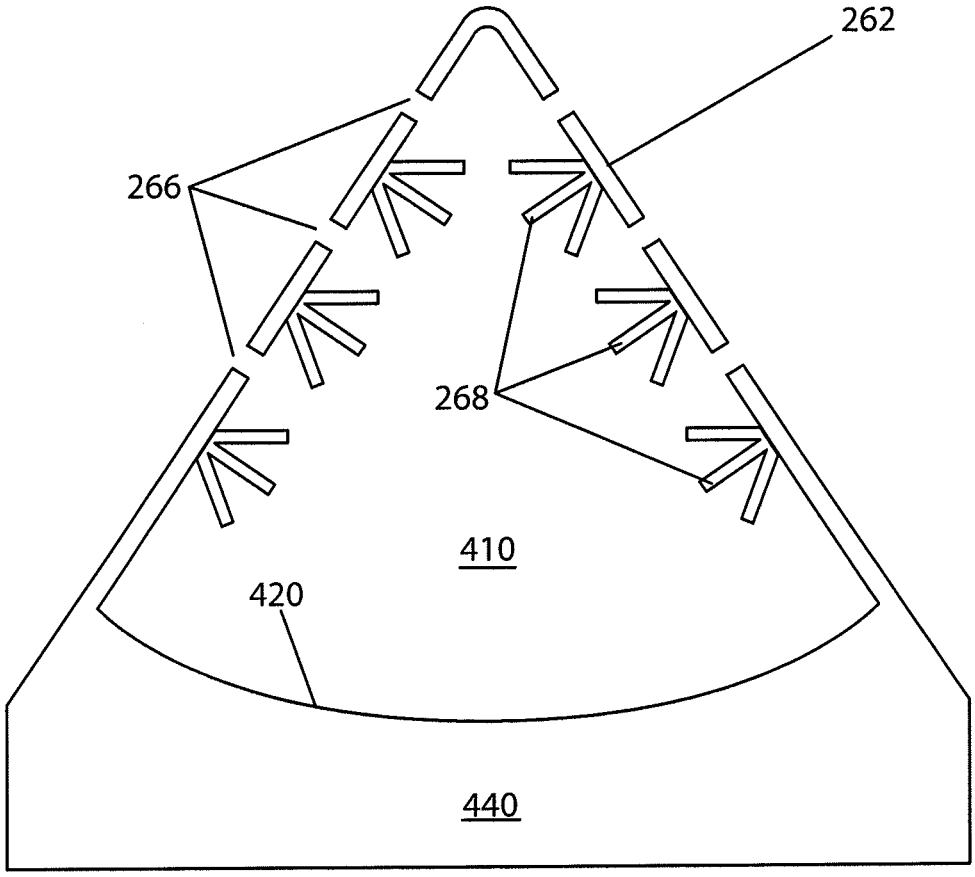
FIG. 8 depicts another cross-sectional view of a base member of a fabric press according to an example embodiment of the present invention.

FIG. 8 illustrates a cross-section of a fabric press according to another example embodiment of the invention, where the cavity disposed beneath the pressing surface 262 includes heat-sinks 268 configured to more efficiently transfer heat from the steam to the pressing surface 262. The heat-sinks 268 may be made of a material with a high coefficient of thermal conductivity, such as aluminum, and may increase the surface area to which the heat from the steam may be transferred. The heat sinks 268 may also serve to help the first pressing surface 262 retain heat when the press is opened.

Figure 9:
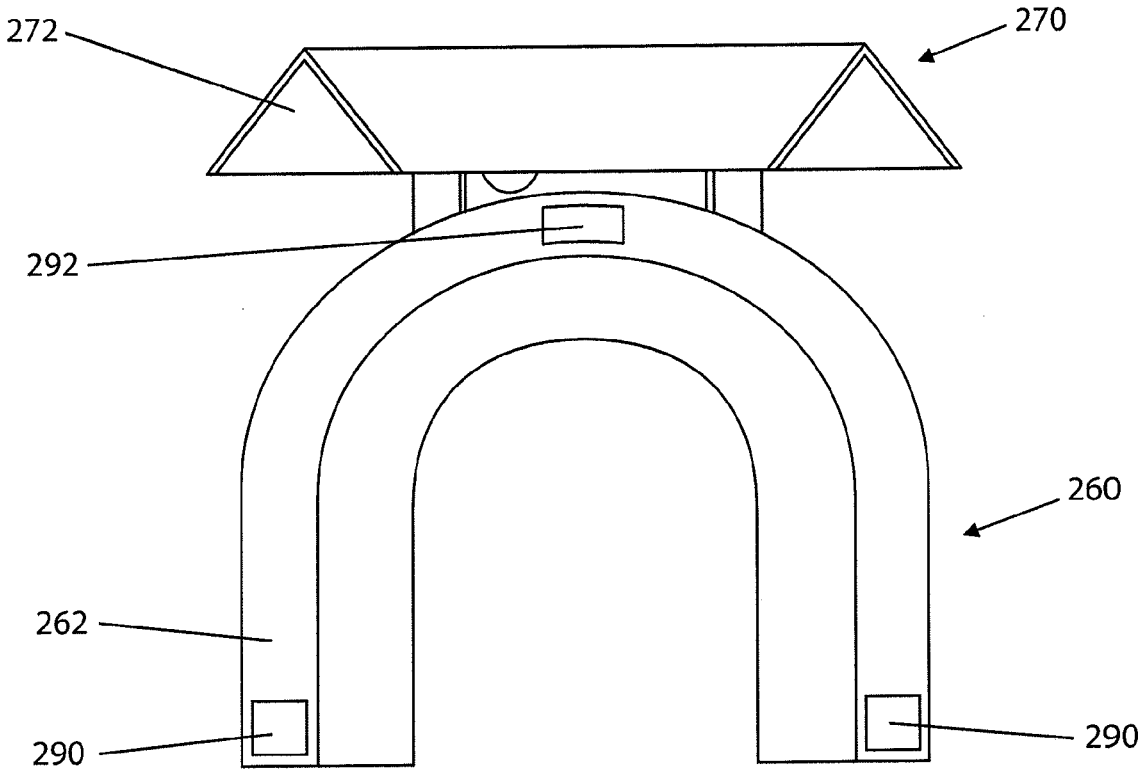
FIG. 9 illustrates a top-view of a fabric press in an open position according to an example embodiment of the present invention.

FIG. 9 illustrates the top view of a press in the open position according to another example embodiment of the present invention. The depicted embodiment illustrates the first pressing surface 262 of the base member 260 with removable inserts 290, 292 disposed thereon. The removable inserts 290, 292 may include a substantially flat surface that is substantially co-planar with the first pressing surface 262; however, these removable inserts may be removed and replaced with embossing inserts (not shown). Embossing inserts may include raised or recess letters, symbols, or figures that may emboss the letter, symbol, or figure, into the collar that is being pressed. For example, a person may use an embossing insert that depicts a monogram of their initials. Replacing removable insert 292 with a monogram embossing insert may cause the monogram to be pressed into the collar of a shirt that is being pressed. In the case of removable insert 292, the monogram would be embossed in the middle of the back of the collar. Removable inserts 290 may be located to accommodate embossing inserts configured to emboss the points of a collar. To accommodate the embossing inserts, the second pressing surface 272 of the lid member 270 may include a respective, cooperative removable insert arranged to receive a cooperative embossing insert, or the second pressing surface 272 may include padded portions that serve to press the collar into engagement with the embossing insert.

As a user may open the lid member and leave the lid open while retrieving a shirt or while being otherwise occupied, it may be undesirable in some situations to allow the fabric press to continue to generate heat and steam while not being used, thereby wasting energy and unnecessarily depleting the fluid in the reservoir. Accordingly, example embodiments of the present invention may include mechanisms by which the press is activated by the closing of the lid member 270 to the base member 260. One method of accomplishing such a mechanism may be to provide a reservoir that is substantially open when the lid member 270 is in the closed (pressing) position and substantially closed when the lid member 270 is in the open position. The heater, which may be on a thermostat or timed cycle, may continue to heat or maintain the fluid at a predetermined temperature when the lid member 270 is open or when the lid member 270 is closed. Upon closing of the lid member 270 to the base member 260, the reservoir may be opened to the cavity 410 beneath the first pressing surface 262 (see FIGS. 6-8), and the steam may then escape to the cavity 410 and heat the first pressing surface 262. The opening and closing of the reservoir may be accomplished by a shutter mechanism operably connected to the lid member 270. Further, as when the lid member 270 is in the open position the reservoir is substantially closed and the heating element may be at least intermittently heating the fluid, a pressure build-up within the reservoir may occur such that upon opening of the reservoir to the cavity 410 (i.e., when the lid member 270 is closed to the press position), the steam is forced from the reservoir through the cavity 410, and out through the perforations 266 in the pressing surface 262. This rapid escape of steam under pressure may expedite the collar pressing process. The pressure within the reservoir while the reservoir is closed to the cavity 410 may be limited by a pressure sensor disposed within the reservoir or by a thermostat limiting the temperature achieved by the fluid in the reservoir to maintain a safe operating pressure within the reservoir.

Another example embodiment of activation of the fabric press when the lid member 270 is closed may include a heating element which serves to maintain the reservoir temperature at a first temperature when the lid member 270 is in the open position, and configured to heat the reservoir fluid temperature to a second, higher temperature when the lid member 270 is moved to the closed position. The first temperature may be maintained at a level which generates little steam, whereas the second temperature may be only marginally higher than the first temperature, but may cause the fluid in the reservoir to vaporize quickly, thereby producing a significant amount of steam in a relatively short amount of time, while not wasting energy and fluid when the lid member 270 is disposed in the open position.

A further example embodiment of activation upon closure of the lid member 270 may include a capacitor that is connected to the heating element. The heating element may operate in a conventional manner, maintaining the reservoir at a temperature sufficient to produce steam when the lid member 270 is in the opened or closed position. However, when the lid member 270 is in the open position, the capacitor may be configured to receive and maintain a charge. Upon closure of the lid member 270 to the base member 260, the charge held in the capacitor may be dissipated to the heating element, creating a substantially instantaneous boost to the heat generated by the heating element and resulting in a substantial temperature rise in the reservoir. The temperature rise may produce additional heat and steam required to more quickly press the shirt collar.

Figure 10:
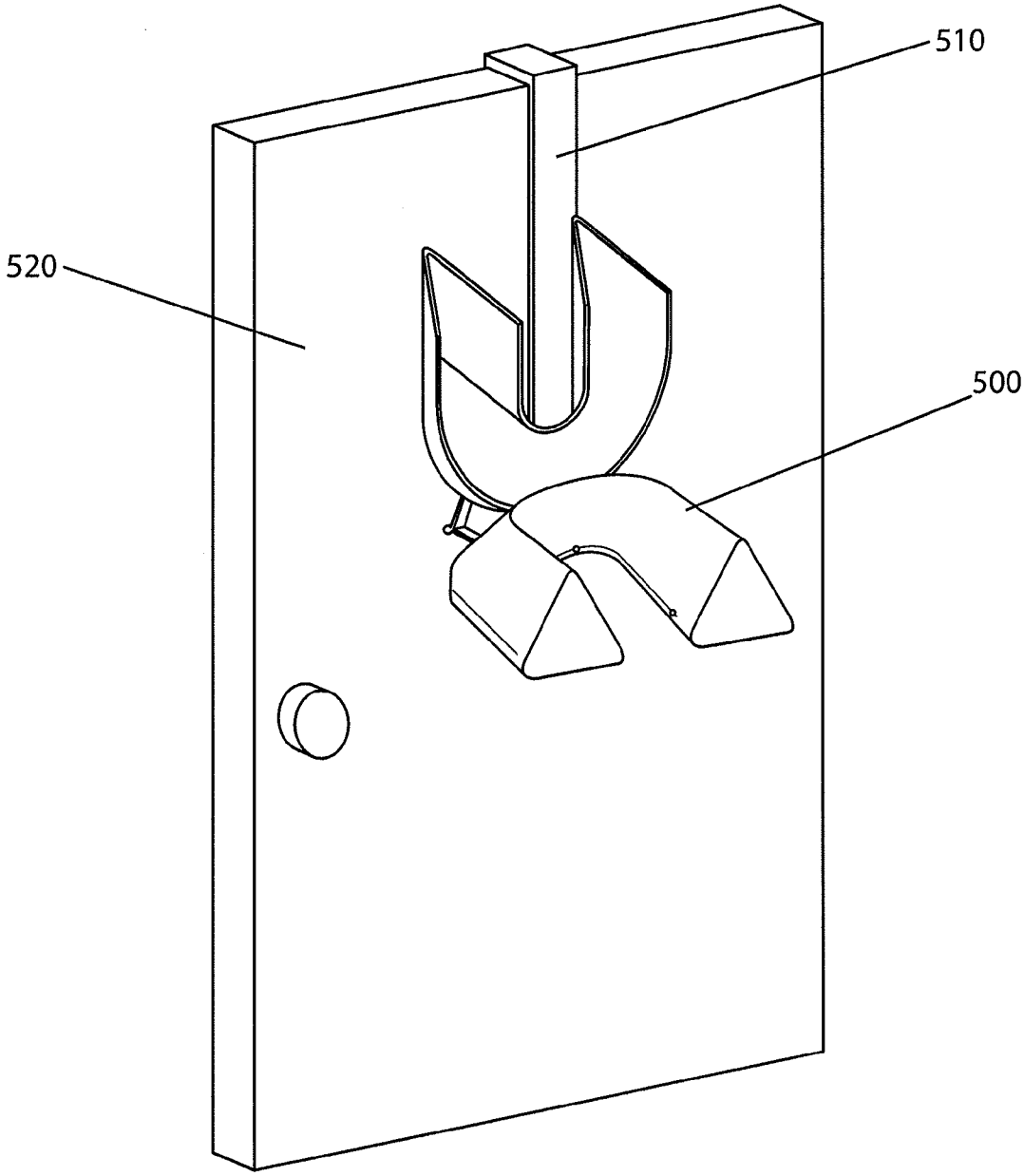
FIG. 10 depicts a fabric press as mounted on a door according to an example embodiment of the present invention.

FIG. 10 depicts an example embodiment of a press 500 that is configured to be mounted on a door 520. The illustrated embodiment includes a hanger 510 configured to engage the edge of a door 520 to support the press 500 in a position wherein a shirt collar may be inserted into the press 500. The hanger 510 may be integral to the base member 260 or, in some cases, may be detachable, such that the press 500 can be used on a table top without the hanger attached or mounted to a door with the hanger attached.

The illustrated embodiment of FIG. 10 may be beneficial to users for a variety of reasons. Users who do not have substantial counter or table space may hang the collar press from a door without clearing counter space on which to place the press. Further, mounting the collar press 500 on a door 520 may accommodate a shirt more easily by allowing the body of the shirt to hang freely beneath the collar press 500 as opposed to draping the body of the shirt laterally across a surface on which the collar press is supported, which may create wrinkles in the body of the shirt. In addition, once the shirt has been pressed and removed from the press 500, the press need not be stored away in a closet or drawer. Rather, the press 500 may be left hanging on the door, out of the way and out of sight (e.g., when the press is hung on the back of a door that is left open) and may, thus be maintained ready for the next pressing operation without giving a messy or unaesthetic appearance to the room.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An apparatus for pressing the collar of a shirt, comprising:

a base member comprising a first press surface, wherein the base is configured generally in the shape of a U, wherein the first press surface comprises a ridge extending along the length of the U shape, and wherein the first press surface is configured to receive a turnover style collar of a shirt along the ridge of the first press surface; and a lid member comprising a second press surface, wherein the second press surface is configured generally in the shape of a U, wherein the lid member is hingedly attached to the base member, and wherein the second press surface is substantially complementary to the first press surface, wherein, in an open position, the first press surface is configured to receive the turnover style collar of the shirt, and wherein, in a closed position, the second press surface is configured to fit over and press the turnover style collar of the shirt.

2. The apparatus according to claim 1, wherein the base member comprises a reservoir for holding a liquid.

3. The apparatus according to claim 2, wherein the reservoir includes a heating element configured to heat the liquid.

4. The apparatus according to claim 3, wherein the first press surface is configured to allow vapor to pass through the first press surface from the reservoir when the liquid is heated.

5. The apparatus according to claim 1, wherein the lid member is hingedly attached to the base proximate a curved portion of the U shape.

6. The apparatus according to claim 1, wherein a fold of the turnover style collar is configured to be received along the ridge of the first press surface.

7. The apparatus according to claim 1, further comprising a removable insert arranged on at least one of the first press surface or the second press surface, wherein the removable insert is configured to emboss a figure on the collar when the lid member is in the closed position.

8. The apparatus according to claim 1, further comprising a hanger adapted to hang the apparatus on a door.

9. An apparatus for pressing the collar of a shirt, comprising:

a base member comprising a first press surface and defining a cavity at least partially bounded by the first press surface, wherein the base member further comprises at least one heat sink disposed within the cavity configured to conduct heat to the first press surface;

a lid member comprising a second press surface cooperative with the first press surface to press the collar of the shirt;

a reservoir containing a fluid; and a heating element disposed within the reservoir, wherein the heating element heats the fluid within the reservoir to generate steam and wherein the steam generated from the fluid heats the first press surface by passing through the cavity.

10. The apparatus according to claim 9, wherein the first press surface includes perforations, and wherein the steam exits the cavity via the perforations to facilitate the pressing of the collar of the shirt.

11. The apparatus according to claim 9, wherein the first press surface further comprises a removable insert, wherein the removable insert is configured to be replaced with an embossing insert.

12. The apparatus according to claim 9, wherein the base member is generally U-shaped.

13. The apparatus according to claim 12, wherein at least a portion of the base member defines a substantially triangular cross-section.

14. The apparatus according to claim 12, wherein the base member includes a ridge that extends around the U-shape, wherein the ridge is configured to engage the fold of the collar of the shirt.

15. An apparatus for pressing the collar of a shirt, comprising:

a base member comprising a first press surface, wherein the base is configured generally in the shape of a U;

a lid member comprising a second press surface, wherein the second press surface is configured generally in the shape of a U, wherein the lid member is hingedly attached to the base member, and wherein the second press surface is substantially complementary to the first press surface; and a removable insert arranged on at least one of the first press surface and the second press surface, wherein the removable insert is configured to emboss a figure on the collar when the lid member is in the closed position;

wherein, in an open position, the first press surface is configured to receive a turnover style collar of a shirt, and wherein, in a closed position, the second press surface is configured to fit over and press the turnover style collar of the shirt.

16. The apparatus according to claim 15, wherein the base member comprises a reservoir for holding a liquid.

17. The apparatus according to claim 16, wherein the reservoir includes a heating element configured to heat the liquid.

18. The apparatus of claim 15, wherein the first press surface comprises a ridge extending along the length of the U shape and wherein the first press surface is configured to receive the turnover style collar of the shirt along the ridge of the first press surface.

19. An apparatus for pressing the collar of a shirt, comprising:

a base member comprising a first press surface;

a lid member comprising a second press surface, wherein the lid member is hingedly attached to the base member, and wherein the second press surface is substantially complementary to the first press surface; and a hanger adapted to hang the apparatus on a door;

wherein, in an open position, the first press surface is configured to receive a turnover style collar of a shirt, and wherein, in a closed position, the second press surface is configured to fit over and press the turnover style collar of the shirt.

20. The apparatus of claim 19, wherein the base is configured generally in the shape of a U, and wherein the second press surface is configured generally in the shape of a U.

21. The apparatus of claim 20, wherein the first press surface comprises a ridge extending along the length of the U shape and wherein the first press surface is configured to receive a turnover style collar of the shirt along the ridge of the first press surface.

22. The apparatus according to claim 19, further comprising a removable insert arranged on at least one of the first press surface and the second press surface, wherein the removable insert is configured to emboss a figure on the collar when the lid member is in the closed position.

* * * * *